US007413377B2

(12) United States Patent
Pontano, III

(10) Patent No.: US 7,413,377 B2
(45) Date of Patent: Aug. 19, 2008

(54) EXTENDABLE WALKWAY SYSTEM FOR SCREED PAVING MACHINES

(75) Inventor: Paul Pontano, III, Williamstown, NJ (US)

(73) Assignee: Asphalt Product Maintenance, Sicklerville, NJ (US)

( * ) Notice: Subject to any disclaimer, the term of this patent is extended or adjusted under 35 U.S.C. 154(b) by 105 days.

(21) Appl. No.: 11/607,212

(22) Filed: Dec. 1, 2006

(65) Prior Publication Data

US 2008/0131204 A1 Jun. 5, 2008

(51) Int. Cl.
*E01C 19/00* (2006.01)
*E01C 19/22* (2006.01)

(52) U.S. Cl. ..... 404/118; 404/83; 404/101

(58) Field of Classification Search ..... 404/83, 404/96, 101, 102, 114, 118
See application file for complete search history.

(56) References Cited

U.S. PATENT DOCUMENTS 3,286,606 A * 11/1966 Layton ..... 404/95
3,557,672 A * 1/1971 Shurtz et al. ..... 404/95
4,360,293 A * 11/1982 Wade ..... 405/268
4,496,265 A * 1/1985 Fragale ..... 404/110
5,059,062 A * 10/1991 Bresnahan ..... 404/110
5,203,642 A * 4/1993 Heller et al. ..... 404/118
RE36,981 E * 12/2000 Birtchet ..... 404/71
6,582,152 B2 * 6/2003 Leone et al. ..... 404/75
2002/0106242 A1 * 8/2002 Rahn et al. ..... 404/96

* cited by examiner

*Primary Examiner*—Raymond W Addie
(74) *Attorney, Agent, or Firm*—Stuart M. Goldstein

(57) ABSTRACT

A walkway extension assembly for a paving machine has main and laterally extendable and retractable screeds and a transversely extending rear catwalk or walkway. The assembly has a laterally extending walkway component extending beneath and on each side of the existing walkway. Channel members are attached to and extend downwardly from bottom surfaces of the existing walkway. The lateral walkway components are positioned beneath the existing walkway on these channel members, and are slideably extendable, laterally and outward from the existing walkway. Brackets are attached between the ends of the walkway components and the sidewalls of the lateral screeds. By this configuration, when the lateral screeds are extended from beneath the paving machine, the lateral walkway components, moving in tandem with the screeds, are also extended. Workers are thus able to stand on the walkway components, outboard of the paving machine itself, to observe the lateral paving operations.

19 Claims, 4 Drawing Sheets

EXTENDABLE WALKWAY SYSTEM FOR SCREED PAVING MACHINES

BACKGROUND OF THE INVENTION

A typical screed type paving machine comprises a paving vehicle with a hopper container at its forward end for receiving asphalt or other paving product from a dump truck. The dump truck is pushed forward along the ground surface to be paved by the paving machine or paver, so that the truck continually discharges its load of paving product into the hopper. A product conveying system on the paver transfers the product from the hopper rearwardly for discharge as a product mat onto the ground surface in front of the screeds of the paver. The screeds smooth, precompact, and level the product mat, to create a smooth, finished road surface. Many such pavers employ a main screed, usually positioned directly beneath the body of the paver itself; and, when paving wider road surfaces, i.e. surfaces wider than the body of the paver, auxiliary screeds which are laterally extendable from the paver are routinely used.

Pavers are also often equipped with rearwardly extending catwalks or walkways which run transversely along the rear of the pavers. A worker will normally stand on this rear walkway and observe the paving operation as the paver moves forward along the road surface, discharging and smoothing its asphalt or other paving product. While the paver proceeds ahead, a worker who is on this walkway can also operate controls at the rear of the paver and continually communicate with the driver of the paver throughout the paving process.

Problems result, however, when the paver's auxiliary screeds are laterally extended, while asphalt or similar material is being laid laterally of the paver. A worker positioned on the rear walkway, which only extends the width of the paver, is limited to movement up to the end of the walkway. He or she cannot fully see or observe the full extent of the lateral paving. Leaning over and down from the end of the walkway does not provide a good view of the work, and leaning past the walkway not only inhibits the efficient use of the rear paver controls, but also presents a danger to the worker. A walkway which is permanently attached to and extends from the existing paver walkway would not be practical and would present a safety hazard as well. It also would create an unnecessary obstruction and an encumbrance during narrow paving surface jobs. To date, attempts to provide some type of adjustable paver walkway have been unsuccessful.

SUMMARY OF THE INVENTION

It is thus the object of the present invention to address the problems and limitations inherent in existing pavers or paving machines.

It is an object of the present invention to provide a paver walkway extension assembly which allows for easy and fast lateral extension of walkways when lateral, wide paving is being done.

It is another object of the present invention to provide a paver walkway extension assembly which provides laterally extendable walkways which will not interfere with paving operations, but will allow the paving worker to continue to safely monitor and observe lateral paved surfaces, as work is progressing.

It is still another object of the present invention to provide a paver walkway extension assembly which permits the paving worker to stand on a lateral walkway, easily and safely use rear paver controls, and have continuous communication with the driver of the paver.

It is a further object of the present invention to provide a paver walkway extension assembly which can simply and quickly be installed, either as a kit for existing paver machines, or as standard equipment on new machines.

It is still another object of the present invention to provide a paver walkway extension assembly which is configured to be installed on existing paver machines with a minimum number of components and without altering the machine or effecting its warranty.

These and other objects are accomplished by the invention, a walkway extension assembly for a paving machine having main and laterally extendable and retractable screeds and a transversely extending rear catwalk or walkway. The assembly has a laterally extending walkway component extending beneath and on each side of the existing walkway. Channel members are attached to and extend downwardly from bottom surfaces of the existing walkway. The lateral walkway components are positioned beneath the existing walkway on these channel members, and are slideably extendable, laterally and outward from the existing walkway. Brackets are attached between the ends of the walkway components and the sidewalls of the lateral screeds. By this configuration, when the lateral screeds are extended from beneath the paving machine, the lateral walkway components, moving in tandem with the screeds, are also extended. Workers are thus able to stand on the walkway components, outboard of the paving machine itself, to observe the lateral paving operations.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
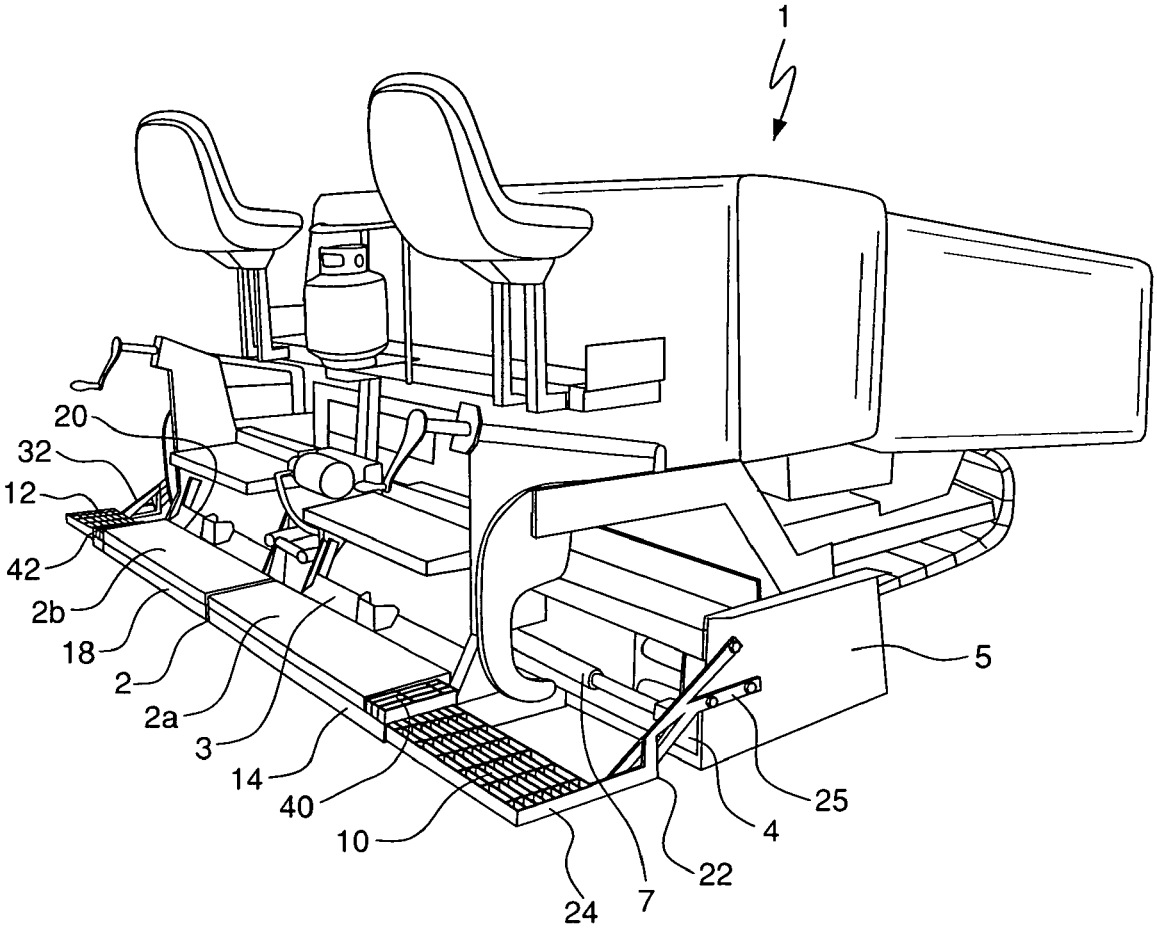
FIG. 1 is a perspective view of a paving machine equipped with the present invention with lateral walkway components extended.
Figure 2:
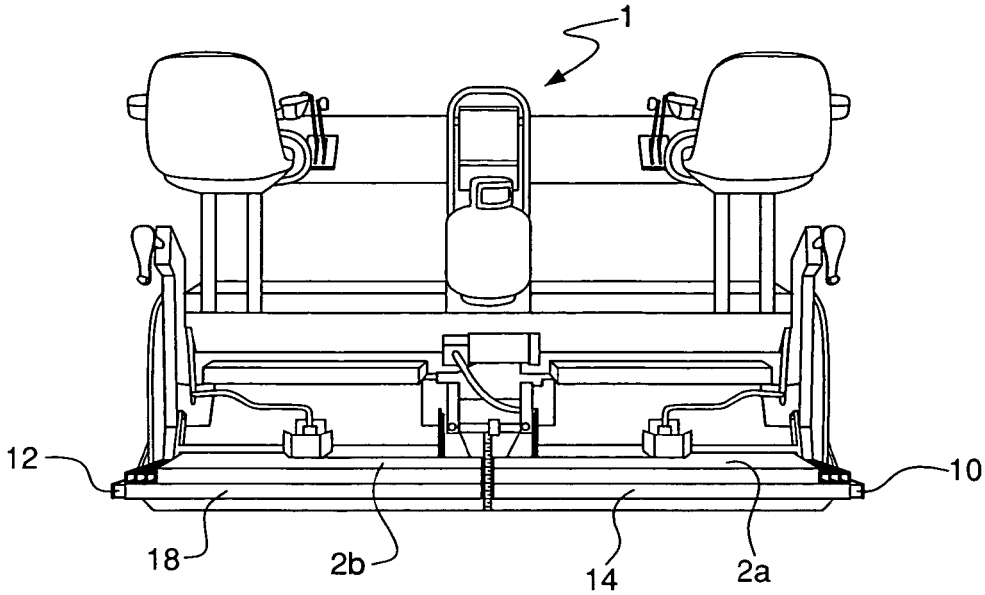
FIG. 2 is a rear view of a paving machine equipped with the present invention with lateral walkway components retracted.
Figure 3:
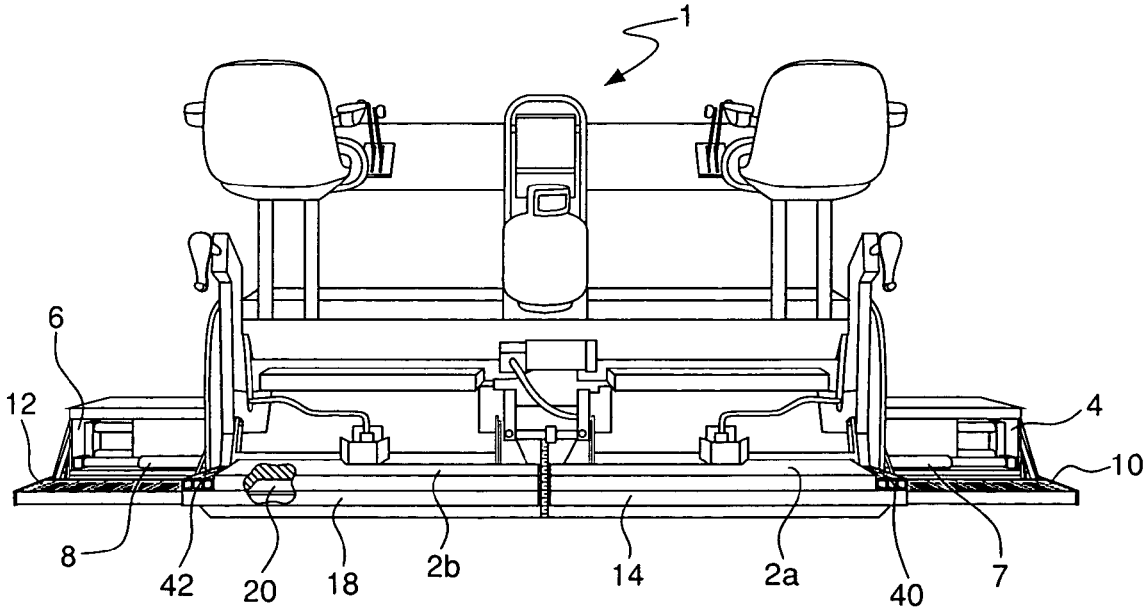
FIG. 3 is a rear view of a paving machine equipped with the present invention with lateral walkway components extended.
Figure 4:
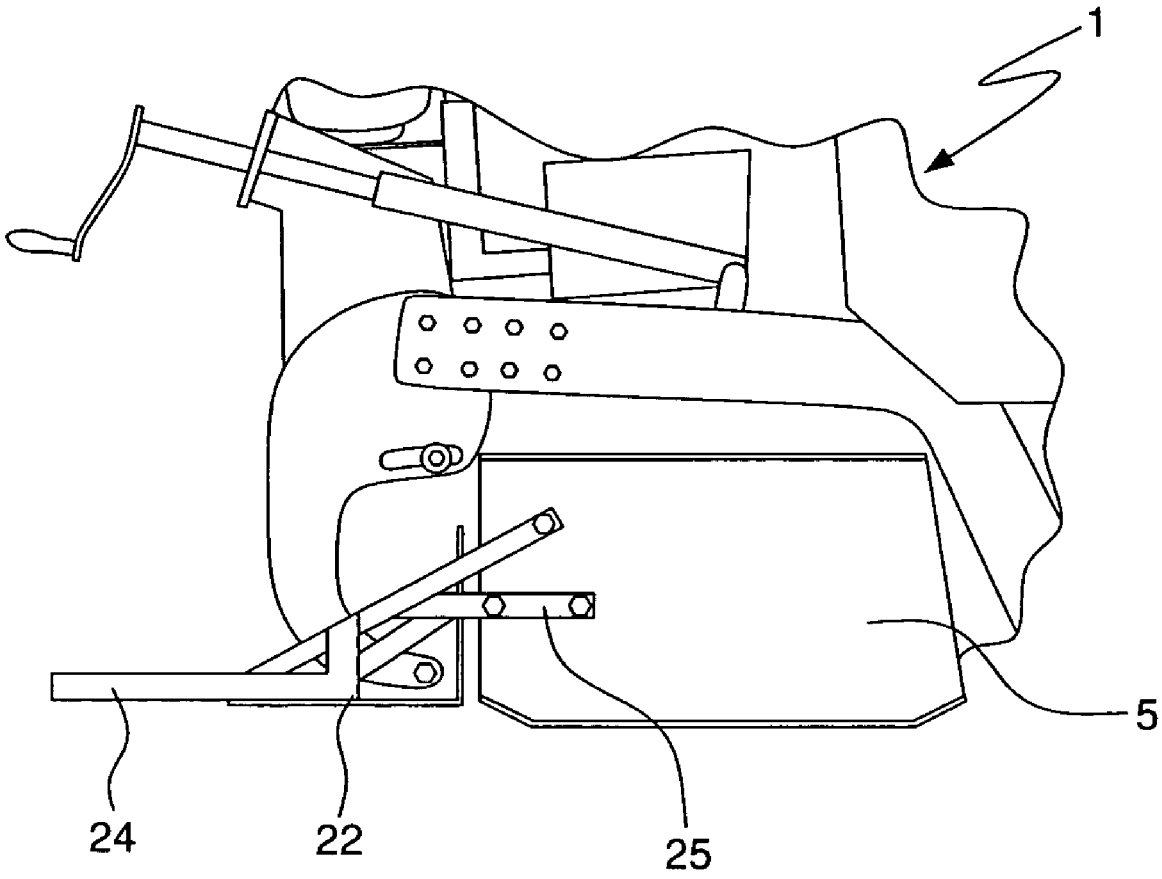
FIG. 4 is a partial side view of a paving machine equipped with the present invention.
Figure 5:
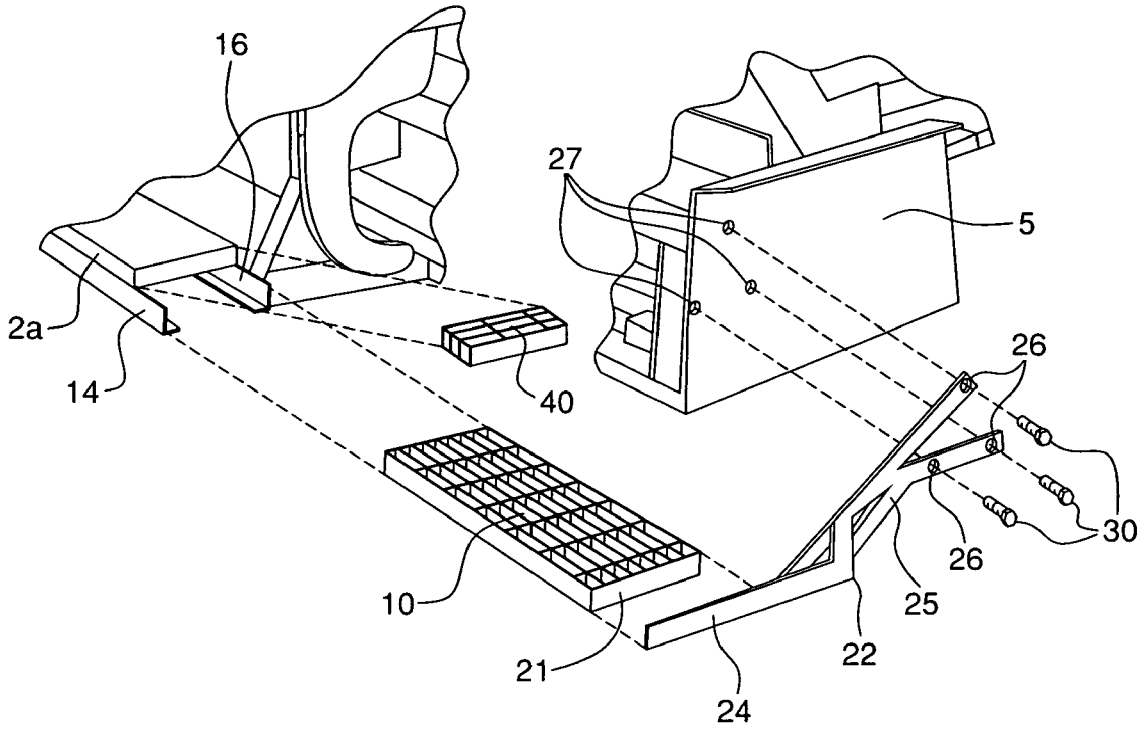
FIG. 5 is an exploded, partial perspective view of a paving machine showing components of the present invention.

Paver or paving machine 1 comprises transversely extending rear catwalk or walkway 2, comprising left half section 2*a* and right half section 2*b*, on which workers stand during the operation of the paving machine. Located beneath paving machine 1 is a main screed generally at 3. Laterally extendable and retractable auxiliary screeds, generally at 4 and 6, are also mounted below paving machine 1. Lateral movement of screeds 4 and 6 is accomplished by hydraulic power means 7 and 8, which is well known in the industry.

The walkway extension assembly of the present invention employs lateral catwalk or walkway components 10 and 12 which are to be mounted beneath walkway 2*a* and 2*b*. "L" shaped outer channel member or track 14 and an inner channel member or track 16 are secured by welding or equivalent means, to the bottom edge surfaces of walkway section 2*a*;

and, secured to bottom edge surfaces of walkway section 2*b* are outer channel member or track 18 and inner channel member or track 20. Walkway components 10 and 12 are positioned on tracks 14, 16, 18, and 20, beneath walkway 2, and are configured to be slideably extendable and retractable on the tracks.

Bracket 22 is secured at one of its ends 24, by welding or equivalent means, to the side end wall 21 of walkway component 10 and, at its second end 25, to sidewall 5 of lateral screed 4. Bracket 22 has bolt holes 26 at second end 25. Bolts 30, original equipment with paving machine 1, normally secure sidewall 5 to components of screed 4. To install bracket 22, bolts 30 are simply removed, the bracket is positioned over sidewall 5 such that bolt holes 26 are aligned over bolt holes 27 through sidewall 5, and the bolts are replaced. Likewise, bracket 32, secured to the side end of walkway component 12 by welding or equivalent means, is similarly attached to lateral screed 6.

Thus, it can be seen that when lateral screeds 4 and 6 are extended outward from paving machine 1, walkway components 10 and 12 slide out to extend from beneath walkway 2 at the same time. By the same token, walkway components are retracted back under walkway sections 2*a* and 2*b* of walkway 2, when screeds 4 and 6 are retracted.

Step extenders 40 and 42 are secured, by welding or equivalent means, the end of walkway sections 2*a* and 2*b* and to track channel members 14, 16, 18 and 20. Step extenders 40 and 42 are provided to assist in maintaining walkway components 10 and 12 in position when they are slid out. These step extenders also provide a step-down surface to assist the footing of the worker.

The walkway extension assembly of the present invention, comprising walkway components 10 and 12, channel members or tracks 14, 16, 18, and 20, brackets 22 and 32, and step extenders 40 and 42, can be provided as a kit, to be installed on existing paving machines. Since attachment of the components of the assembly is simply accomplished by welding channel members 14, 16, 18, and 20 to walkway 2 and by securing brackets 22 and 32 to screeds 4 and 6 by use of bolts 30, already provided and in use on paving machine 1, there is no material alteration to the machine and no potential breach of any product warranties. Of course, the walkway extension assembly of the present invention can also be provided to the paving machine manufacturer to be installed as original equipment.

When walkway components 10 and 12 are extended outward from paving machine 1 during paving operations, workers can safely stand outboard of the machine, even while it is moving, to clearly observe and check the surfaces being paved, to operate paver controls, and to continue direct communications with the driver of the paving machine.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A walkway extension assembly for a paving machine with a main screed, laterally extendable and retractable screeds, and a rearwardly extending platform walkway, said extension assembly comprising:

walkway means moveably positioned in relation to the rearwardly extending platform walkway and extendable laterally outward from the platform walkway;

track means secured to the platform walkway to allow slideable movement of the walkway means from a position beneath the platform walkway to a plurality of laterally extended positions; and support means secured between the walkway means and the laterally extendable screeds to maintain the walkway means in position in relation to the platform walkway.

2. The walkway extension assembly as in claim 1 wherein the paving machine comprises power means to extend and retract said laterally extendable screeds, whereby the walkway means is laterally extendable in tandem with extension and retraction of the laterally extendable screeds.

3. The walkway extension assembly as in claim 1 wherein the track means comprise channel members extending downwardly from the platform walkway.

4. The walkway extension assembly as in claim 1 wherein the support means comprises brackets secured between the ends of the walkway means and the laterally extendable screeds.

5. The walkway extension assembly as in claim 4 wherein the brackets are attached to outer sidewalls of the laterally extendable screeds.

6. The walkway extension assembly as in claim 1 wherein the walkway means comprises two walkway components, one extending from each side of the platform walkway.

7. The walkway extension assembly as in claim 1 further comprising means secured to the platform walkway and the track means for providing assistance in maintaining the walkway means in said laterally extended positions.

8. A paving machine comprising:

a main screed;

laterally extendable and retractable screeds moveable in relation to the main screed;

a rearwardly extending platform walkway;

walkway means moveably positioned in relation to the rearwardly extending platform walkway and extending laterally outward from the platform walkway;

track means secured to the platform walkway to allow slideable movement of the walkway means from a position beneath the platform walkway to a plurality of laterally extended positions; and support means secured between the laterally extendable screeds and the walkway means to maintain the walkway means in position in relation to the platform walkway.

9. The paving machine as in claim 8 further comprising power means to extend and retract said laterally extendable screeds, whereby the walkway means is laterally extendable in tandem with the extension and retraction of the laterally extendable screeds.

10. The paving machine as in claim 8 wherein the track means comprise channel members extending downwardly from the platform walkway.

11. The paving machine as in claim 8 wherein the support means comprises brackets secured between the ends of the walkway means and the laterally extendable screeds.

12. The paving machine as in claim 11 wherein the brackets are attached to outer sidewalls of the laterally extendable screeds.

13. The paving machine as in claim 8 wherein the walkway means comprises two walkway extensions, one extending from each side of the platform walkway.

14. The paving machine as in claim 8 further comprising means secured to the platform walkway and the track means for providing assistance in maintaining the walkway means in said laterally extended positions.

15. A walkway extension kit for installation on a paving machine with a main screed, laterally extendable and retractable screeds, and a rearwardly extending platform walkway, said extension kit comprising:

walkway means configured to be moveably positioned in relation to the rearwardly extending platform walkway and to be extendable, laterally outward from the platform walkway;

a plurality of channel members configured to be secured to the platform walkway to allow slideable movement of the walkway means from a position beneath the platform walkway to a plurality of laterally extended positions; and a plurality of bracket members configured to be secured between the laterally extendable screeds and the ends of the walkway means to maintain the walkway means in position in relation to the platform walkway.

16. The walkway extension kit as in claim 15 wherein the channel members are configured to extend downwardly from the platform walkway.

17. The walkway extension kit as in claim 15 wherein the brackets are configured to be attached to outer sides of the laterally extendable screeds.

18. The walkway extension kit as in claim 15 wherein the walkway means comprises two walkway extensions, one extending from each side of the platform walkway.

19. The walkway extension kit as in claim 15 further comprising means configured to be secured to the platform walkway and said channel members for providing assistance in maintaining the walkway means in said laterally extending positions.

* * * * *